US010035573B2

(12) United States Patent
Rice

(10) Patent No.: US 10,035,573 B2
(45) Date of Patent: Jul. 31, 2018

(54) WATER FLOTATION DEVICE WITH MEGAPHONE

(71) Applicant: Cambium 5, Hermosa Beach, CA (US)

(72) Inventor: Jeffery D. Rice, Hermosa Beach, CA (US)

(73) Assignee: CAMBIUM 5, Hermosa Beach, CA (US)

( * ) Notice: Subject to any disclaimer, the term of this patent is extended or adjusted under 35 U.S.C. 154(b) by 0 days.

(21) Appl. No.: 15/373,771

(22) Filed: Dec. 9, 2016

(65) Prior Publication Data

US 2018/0162499 A1 Jun. 14, 2018

(51) Int. Cl.
*B63C 9/20* (2006.01)
*B63C 9/08* (2006.01)

(52) U.S. Cl.
CPC ..... *B63C 9/20* (2013.01)

(58) Field of Classification Search
CPC ..... B63C 9/20; G10K 11/08; G10K 13/00; G10K 15/00; E01F 9/654
USPC ..... 441/125, 11, 12, 89; 181/21, 22
See application file for complete search history.

(56) References Cited

U.S. PATENT DOCUMENTS 4,703,829 A * 11/1987 Hardt ..... G10K 11/08 181/178
5,163,858 A 11/1992 Sumrall
5,234,144 A * 8/1993 Iler ..... B63C 9/20 220/375
5,813,891 A 9/1998 McNamee
5,938,095 A * 8/1999 Haar ..... A45C 3/10 224/235
6,568,976 B2 * 5/2003 Anderson ..... B63C 9/26 441/80
7,896,719 B2 * 3/2011 Rayles ..... B63C 9/065 441/80
8,882,555 B2 11/2014 Mulligan et al.
9,238,502 B2 * 1/2016 Shackcloth ..... B63C 9/08
2006/0042014 A1 * 3/2006 Martin ..... A47C 7/021 5/653
2014/0283733 A1 * 9/2014 Archer ..... E01F 9/654 116/63 C

FOREIGN PATENT DOCUMENTS

CN 2516455 Y 10/2002
CN 104670437 A 6/2015
RU 2191133 C2 10/2002
WO 2014200136 A1 12/2014

OTHER PUBLICATIONS

"International Search Report and Written Opinion for PCT Patent Application No. PCT/US2017/065609", dated Mar. 29, 2018, 6 pages.

* cited by examiner

*Primary Examiner* — Anthony D Wiest
(74) *Attorney, Agent, or Firm* — Medley, Behrens & Lewis, LLC; Lorri W. Cooper

(57) ABSTRACT

A water safety flotation device includes a buoyant body and a hollow core. The buoyant body has a length and a width, with the length defining a longitudinal axis of the device. The hollow core extends along the longitudinal axis of the body. The hollow core is substantially conical and provides a first opening in the body at a first end and a second opening in the body at a second end. The hollow core serves the function of a megaphone.

17 Claims, 4 Drawing Sheets

WATER FLOTATION DEVICE WITH MEGAPHONE

BACKGROUND

Water safety personnel require the means to communicate effectively with individuals at a considerable distance from shore and provide flotation assistance to those in danger of drowning. Lifeguards often carry whistles and floatation devices, and spend their days yelling at people under their care. They often cup their hands around their mouths in the hope of having their shouts heard at longer distances, and above the roar of any waves or outside noise. This can result in a loss of voice to the lifeguard, which can decrease the level of safety overall.

Lifeguards at pools, lakes, or the ocean typically carry or have readily accessible rescue floatation devices, such as rescue buoys. Types of known rescue buoys include ring buoys, rescue tubes, and rescue cans, among other devices.

Ring buoys are ring-shaped floatation devices. They may be thrown to a user so that the user can grab the ring for floatation support. Ring buoys may have a connecting line to permit the user to be pulled to a rescuer in a boat. They are typically found on ships or boats, and are also often located beside bodies of water that have the depth or potential to drown someone. Ring buoys can be made of a urethane foam core that is coated with a vinyl-coated nylon skin. Ring buoys can also be made from a hard, plastic material, such as cross-linked polyethylene or vinyl. Other constructions of ring buoys are known.

Rescue tubes are elongated, generally rectangular devices that are made of a coated foam material and that are typically flexible or bendable. These devices oftentimes have mechanisms, such as loops and hooks or quick release buckles that permit the device to be placed around a user's mid-section to form a loop or ring when the ends of the tube are connected together. Alternatively, this device could be extended to a user so that the user has something to grab onto. The user could also lay their body on the tube to aid in floatation. These devices also often include an embedded strap that extends end to end to provide additional support to the construction of the tube. Types of coatings that are known include, but are not limited to, nylon mesh and vinyl.

Rescue cans are similar to rescue tubes, but they are generally rigid and include handles on the sides that permit a user to more easily grab onto them. Rescue cans are typically made from a hard-plastic material. Types of known material that are used to form rescue cans are linear plastic and high density polyethylene, among other materials.

SUMMARY

The present invention concerns an improved water safety flotation device, as shown and described.

DETAILED DESCRIPTION

Figure 1:
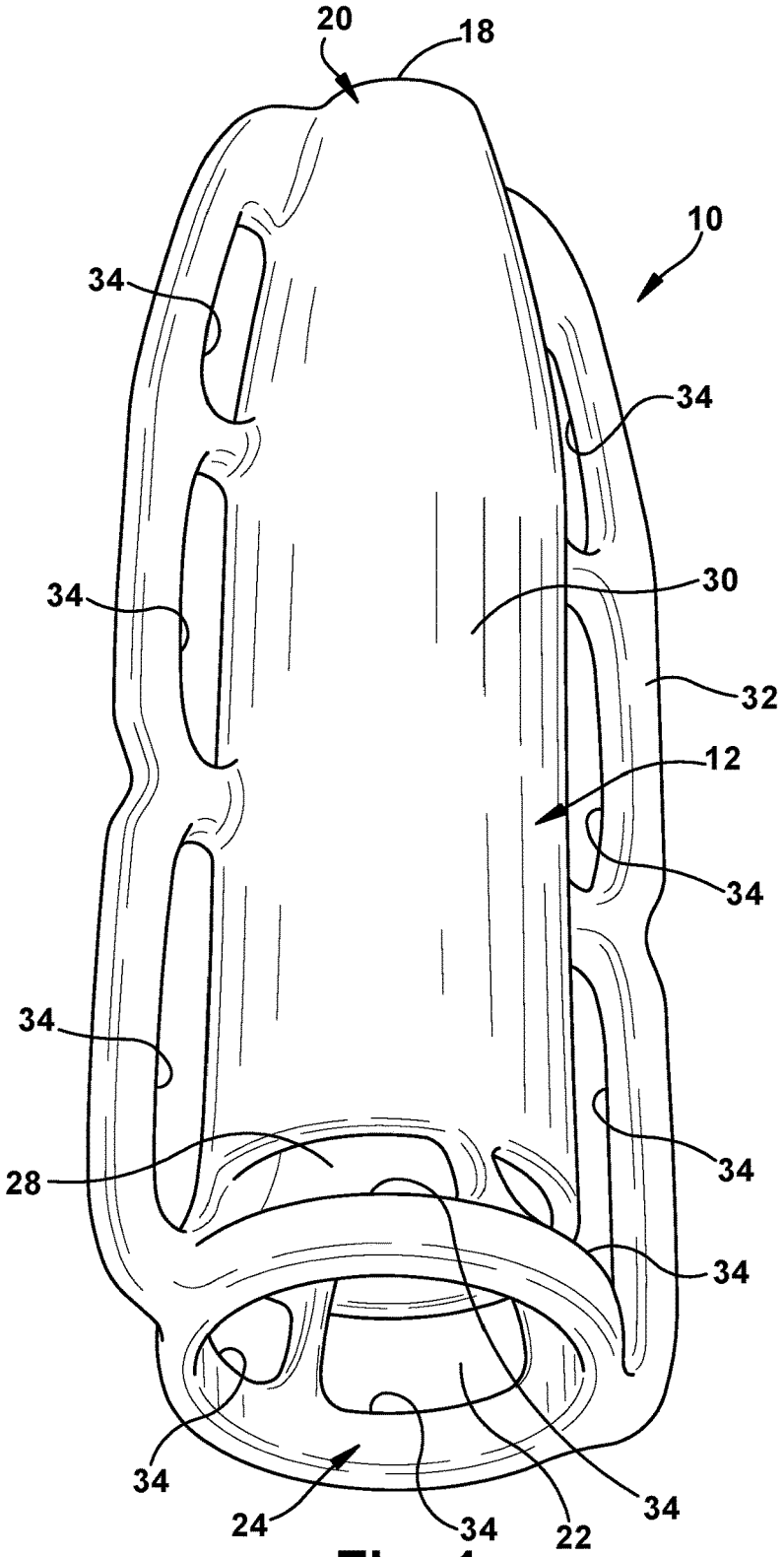
FIG. 1 is a perspective view of an example water rescue flotation device according to the invention.

Water safety personnel, e.g., lifeguards, are typically required to carry a rescue buoy to provide flotation assistance to swimmers who may need assistance. No similarly effective tool is required or provided to facilitate verbal communication at a distance. A rescue buoy has no real function out of the water, yet lifeguards are typically required to carry these devices at all times while on duty. Most of a lifeguard's time is spent out of the water observing for signs of danger and providing instructions to those in the water to avoid the need for rescue. Their primary responsibility is, therefore, to communicate to keep people out of dangerous situations. Presently known flotation devices do not serve that purpose.

Water safety personnel require the means to verbally communicate effectively with individuals at a considerable distance from shore and provide flotation assistance to those in danger of drowning. To date, yelling, often over the sounds of winds and waves, has been the only choice. While this can be effective, yelling can be exhausting and even harmful to the voice.

The example water rescue flotation device 10 shown and described herein is a rescue buoy that incorporates many features of a standard rescue buoy, but is shaped in the shape of a megaphone to allow the lifeguard who is using the device to better communicate with swimmers or others via the megaphone feature. The water rescue device described herein provides a complete toolkit for water safety. By incorporating a megaphone within the body 12 of a rescue buoy 10, the water rescue device 10 allows water safety personnel to amplify, direct and project the sound of a rescuer's voice or other sound source over considerable distances without the burden of carrying additional equipment.

The water rescue device 10 may also incorporate a whistle 14 that is regularly coupled to the housing/body 12 of the rescue buoy. The whistle 14 may be removable, or may be formed as part of the rescue buoy so that it is not removable (not shown). The whistle 14 may be any shape and does not have to be the shape shown. The whistle 14 could alternatively be connected to the rescue buoy via a lead or cord, or positioned in a holder that is attached to the body 12 (not shown).

The example water rescue device 10 provides two functions that have not been previously provided by a rescue buoy—a megaphone and a whistle. Rescue buoy technology is old and there have not been many changes or improvements to the art in recent years. The presently described water rescue device 10 is an innovation because it adds efficiency to the system by providing the user of the rescue device 10 with the ability to use the rescue device 10 as a combined rescue device and signaling device. In particular, the lifeguard no longer needs to yell at the top of his lungs, or use both a rescue buoy 10 and a separate megaphone (as well as a separate whistle). The example device 10 allows the features of life saving and notification in a single device where 3 separate devices were previously required.

The example water rescue device 10 is used first to communicate with a swimmer or other person, and then to provide flotation assistance to an individual or individuals in danger of drowning. The megaphone portion of the device 10 is defined by an internal opening 16 defined in the device and can be used to amplify, direct and project a rescuer's voice or other sound source to communicate until a rescuer is close enough to communicate directly and deliver the device to the victim(s) for flotation assistance.

The example water rescue device 10 is shown in FIGS. 1-5. As shown the device 10 has a buoyant body 12 that is generally shaped like a standard rescue can, but with the addition of a tubular and/or conical opening 16 extending longitudinally through the center of the device 10. As shown in FIG. 1, the rescue device has a length that defines a central axis X-X. The center of the device, extending along the longitudinal axis, is hollow 16 with an opening at both ends. A first opening 18 is positioned at the first end 20 of the device 10 and a second opening 22 is positioned at the second end 24 of the device 10. The first opening 18 is smaller than the second opening 22 and the interior walls 26 of the hollow inner portion 16 are conical or otherwise shaped to permit the projection of sound.

Figure 3:
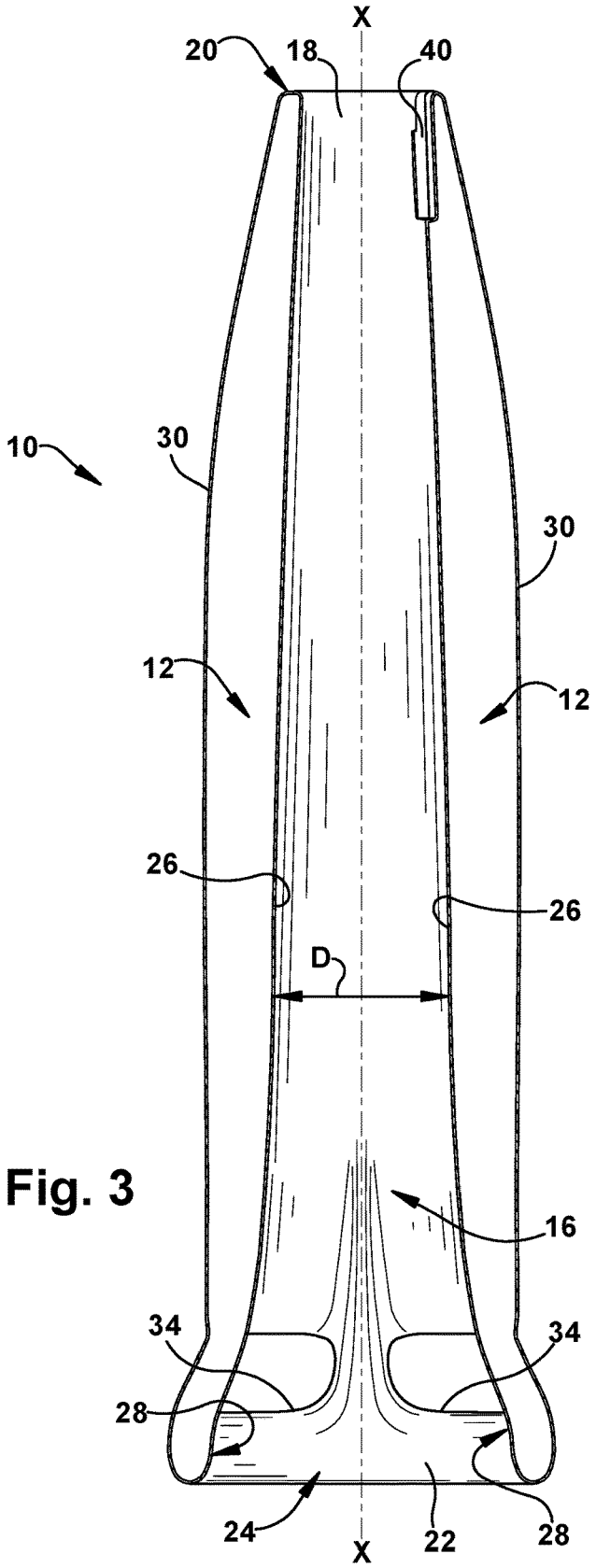
FIG. 3 is a cross-sectional view of the example device of FIG. 2, taken at line 3-3.

FIG. 3 shows a cross-sectional view of the example water rescue device body 12 as having a conical wall 26 that increases along the length of the device 10. The example shown has a constantly sloping inner wall 26 until reaching the end 28 of second end 24 of the device, where the slope of the wall increases to further help to amplify any sound in the megaphone. The conical wall shape 26 that is shown is only shown as an example. The wall 26 could be more steeply shaped along its entire length. The wall 26 could be a constant steepness along its length, or could vary in steepness along its length, as desired. Some shapes may provide better amplification than others. At the same time, is desirous to keep the form factor for the device as small as reasonably possible since the water safety personnel is typically carrying the device around with them all day.

In use, the user talks or yells into the narrower first end 20 and the sound exits the megaphone in an amplified manner at the second end 24 of the device 10. If desired, additional amplification could be provided by means such as the addition of waterproof electronics, or other known means for sound amplification.

The water safety device 10 also incorporates other features that are typically present on a rescue can. In particular, on an outer surface 30 of the device 10, several handles are formed. Two longitudinally extending rails 32 that extend along the length of the device 10 on opposing sides thereof provide three hand grips 34 per rail for a total of six hand grips 34. In addition, the device 10 incorporates hand grips or handles 34 that surround the second end 24 of the device 10, although hand grips 34 could also be positioned around the first end 18 of the device 10, if desired. Alternatively, handles 34 are not absolutely required on the first or second end 18, 22, or along the length of the device 10. The handles 34 are also advantageous to the rescuer, since they provide a position for the rescuer to grasp the device 10 when pulling someone to shore. The handles 34 may have a shape or surface texture that helps a user to grasp and hold onto the handles 34, if desired.

In use, when the rescuer moves the device 10 close to a swimmer, the swimmer can easily grab the handles 34, thus avoiding jumping on the water safety personnel. The rescuer can keep a "safe" distance from the swimmer until the swimmer calms down. This is also advantageous in that it could be used by a rescuer who is not an expert swimmer, but who is lending aid to help someone avoid drowning.

Figure 2:
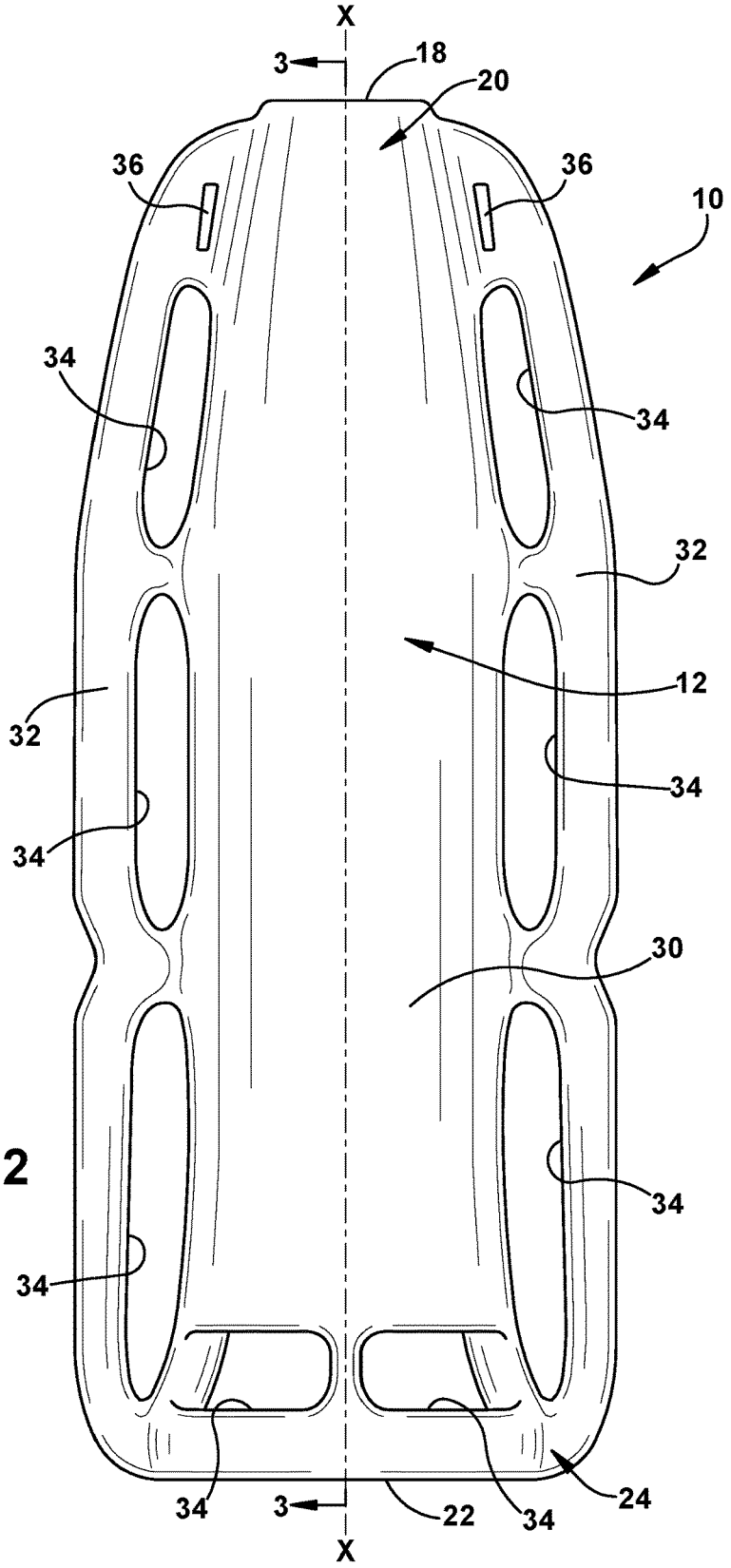
FIG. 2 is a top view of the example device shown in FIG. 1.

The device 10 also may incorporate slots 36 for a carrying strap (not shown), as shown in FIG. 2. The slots 36 are shown positioned near the first end 20 of the device 10. A strap can be coupled through the slots 36 in the first end 20 and around the handles 34 at the second end 24, if desired, or could simply just extend through slots 36 at the first end 20. The carrying strap could be connected in other ways, as would be readily evident to someone of skill in the art.

Figure 4:
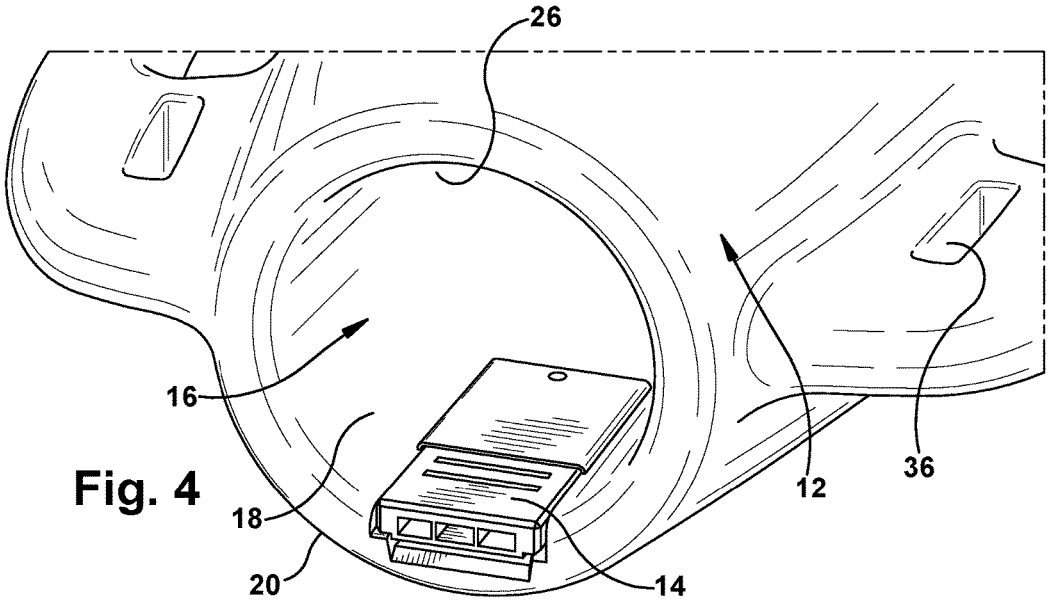
FIG. 4 is a perspective view of a whistle positioned in the housing of the example water rescue device according to the invention.
Figure 5:
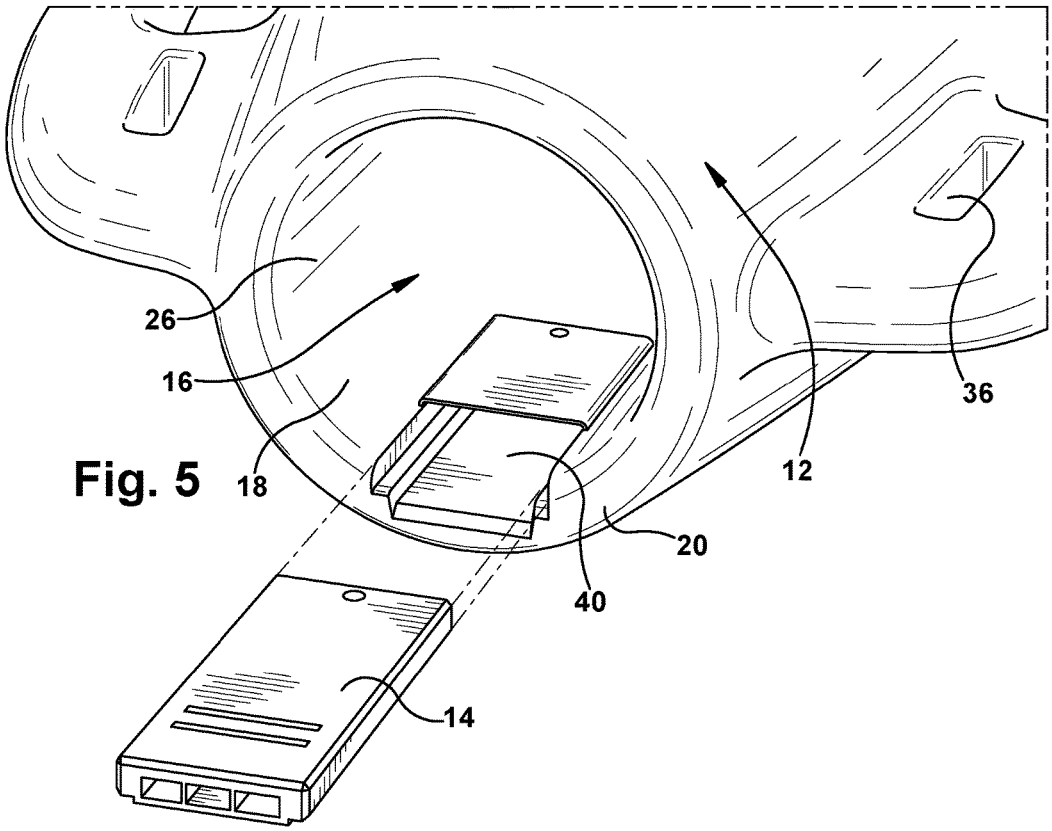
FIG. 5 depicts the same view as FIG. 4, but with the whistle removed from the housing.

FIGS. 4 and 5 depict an accessory for use with the water rescue device 10 in the form of a whistle 14. The whistle 14 is shown in an installed position in the rescue device 10 in FIG. 4, and in a removed position from the rescue device 10 in FIG. 5. A slot or recess 40 is formed in the body 12 of the device 10 at the first end 20 thereof to accommodate and hold the shape of a whistle 14. While a flat whistle 14 is shown, other shapes could also be used. In addition, the whistle 14 could be tethered to the rescue can using a string or cord, if desired, to avoid misplacing the whistle 14 (not shown). As discussed above, since lifeguards typically carry around floatation devices during their entire shifts, the placement of the whistle 14 in the body 12 of the rescue device 10 would prevent the lifeguard from having to carry a separate whistle. As an alternative to a recess 40 being formed in the buoy body 12, a receptacle or holder could be attached to the body of the buoy to hold a whistle 14 or other tool (not shown).

The example water rescue device 10 is buoyant and does not take on any appreciable amount of water that would affect buoyancy to any significant extent. It can be made in any way known by those of skill in the art of water safety and rescue. One technique involves injection molding the device as a single piece using plastic, such as HDPE. The interior of the molded device can be hollow to provide buoyancy, although part or all of the device 10 could be solid plastic to provide strength. The molded device 10 could also be filled with a buoyant material, if desired. Alternatively, the device 10 could be made of a foam material that is coated and strengthened, as known by those of skill in the art.

A first example water safety flotation device 10 includes a buoyant body 12 and a hollow core 16. The buoyant body 12 has a length and a width, with the length defining a longitudinal axis X-X. The hollow core 16 extends along the longitudinal axis X-X of the body 12. The hollow core 16 is substantially conical and provides a first opening 18 in the body at a first end 20 thereof and a second opening 22 in the body 10 at a second end 24 thereof. The hollow core 16 serves the function of a megaphone.

The flotation device 10 first opening 18 may have a size that is smaller than a size of the second opening 22. The first and second openings 18, 22 may be at opposite ends of the body 12. The flotation device 10 may also include handles 34 extending outwardly from an exterior surface 30 of the body 12. The flotation device 10 may also include a recess 40 or a holder, and a whistle 14 positioned in the recess 40 or holder and being removable therefrom. The body 12 may be made of a plastic material.

The megaphone, e.g., hollow core 16, is shaped to amplify, direct and project, either acoustically or electronically, a voice, whistle 14 or other sound source across a greater distance and with greater focus than could be achieved without the megaphone.

Another example water safety flotation device 10 includes a buoyant body 12 and a hollow interior 16. The buoyant body 12 has a longitudinal axis X-X defined along a length of the body 12, with the body 12 having a first end 18 and a second end 22. The hollow interior 16 extends from the first end 18 of the body 12 to the second end 22 of the body 12. A first opening 18 is formed in the body 12 at the first end 20 thereof and a second opening 22 of the body 12 is formed at the second end 24 thereof. The hollow interior 16 has an inner diameter D that increases along the length of the buoyant body 12 between the first end 18 and the second end 22 thereof. The hollow interior 16 serves a function of a megaphone, and a user communicates into the first opening 18 and amplified sound exits the second opening 22.

The flotation device 10 first opening 18 may be smaller than the second opening 22. The first opening 18 may be at an opposite end to the second opening 22. The flotation device 10 may further include handles 34 positioned on an exterior 30 of the buoyant body 12. The handles 34 may be integrally formed with the buoyant body 12. The handles 34 may include at least one rail 32 that extends along an exterior surface 30 of the buoyant body 12 along at least part of the length thereof, with the rail 32 incorporating at least one handle 34. Multiple rails 32 may be provided on an exterior surface 30 of the buoyant body 12 and two or more handles 34 are associated with the rails 32. Handles 34 may also be positioned at one or both of the first and second ends 18, 22 of the buoyant body 12. The handles 34 are configured for grasping by a user.

A recess 40 or holder may be provided in or on the buoyant body 12 for accepting a tool. The tool may be a whistle 14. The whistle 14 may be removable and replaceable into the recess 40 or holder of the buoyant body.

The flotation device 10 may include a permanently attached or detachable tether secured at at least one end of the device 10. The tether may have a fixed length or an adjustable length. The tether may be a chain, a rope, a line, a cord, or a combination thereof. The tether may form a sling, loop, hook, ring, or harness that can be slung over a person's body, worn by a person, or otherwise attached to a person with any known means, or attached to a watercraft with any known means, allowing for towing of a person or persons holding onto the device 10.

The term "substantially," if used herein, is a term of estimation.

While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use embodiments having alternative elements that likewise correspond to the elements of the invention recited in the claims. The intended scope of the invention may thus include other embodiments that do not differ or that insubstantially differ from the literal language of the claims. The scope of the present invention is accordingly defined as set forth in the appended claims.

What is claimed is:

1. A water safety flotation device comprising:

a buoyant body having a length and a width, with the length defining a longitudinal axis;

a hollow core extending along the longitudinal axis of the body, said hollow core being substantially conical and providing a first opening in the body at a first end and a second opening in the body at a second end, wherein the hollow core serves the function of a megaphone; and a rail extended outwardly and longitudinally beyond the second opening and encircling the second opening, the rail having at least one aperture formed between the second end of the buoyant body and an outer perimeter of the rail to form a handle.

2. The device of claim 1, wherein the first opening has a size that is smaller than a size of the second opening.

3. The device of claim 1, wherein the first and second openings are at opposite ends of the body.

4. The device of claim 1, further comprising rails extending longitudinally along the length of the body and extending outwardly from an exterior surface of the body.

5. The device of claim 1, further comprising a recess or a holder, and a whistle positioned in the recess or holder.

6. The device of claim 1, wherein the body is made of a rigid plastic material.

7. The device of claim 1, wherein the megaphone is shaped to amplify, direct and project, either acoustically or electronically, a voice, whistle or other sound source across a greater distance and with greater focus than could be achieved without the megaphone.

8. A water safety flotation device comprising:

a buoyant body having a longitudinal axis defined along a length of the body, with the body having a first end and a second end;

a hollow interior extending from the first end of the body to the second end of the body, with a first opening formed in the body at the first end thereof and a second opening of the body formed at the second end thereof, wherein the hollow interior has an inner diameter that increases along the length of the buoyant body from a smaller size at the first end to a larger size at the second end, the hollow interior serves a function of a megaphone, and a user communicates into the first opening and amplified sound exits the second opening; and at least one longitudinal rail attached to an exterior of the buoyant body and extending along the length of the buoyant body;

a rail encircling the second end of the buoyant body; and at least one aperture formed in each of the longitudinal rail and the rail encircling the second end of the buoyant body, the apertures forming handles between the longitudinal exterior of the buoyant body and the second end of the buoyant body.

9. The device of claim 8, wherein the first opening is at an opposite end to the second opening.

10. The device of claim 8, wherein the at least one longitudinal rail is two longitudinal rails along the length of the body on opposite sides of the exterior of the buoyant body.

11. The device of claim 10, wherein the rails are integrally formed with the buoyant body.

12. The device of claim 8, further comprising one or more handles positioned at the first end of the buoyant body, wherein the handles are configured for grasping by a user.

13. The device of claim 8, further comprising a recess or holder provided in or on the buoyant body for accepting a tool.

14. The device of claim 13, wherein the tool is a whistle, and the whistle is removable and replaceable into the recess of the buoyant body.

15. The device of claim 8, further comprising a permanently attached or detachable tether secured at at least one end of the device, wherein the tether has a fixed length or an adjustable length.

16. The device of claim 15, wherein the tether is a chain, a rope, a line, a cord, or a combination thereof, and the tether forms a sling, loop, hook, ring, or harness that can be slung over a person's body, worn by a person, or otherwise attached to a person with any known means, or attached to a watercraft with any known means, allowing for towing of a person or persons holding onto the device.

17. The device of claim 8, wherein the buoyant body is made of a rigid plastic material and is hollow.

* * * * *